US009051713B1

(12) United States Patent
Thompson

(10) Patent No.: US 9,051,713 B1
(45) Date of Patent: Jun. 9, 2015

(54) BACKFILLING ATTACHMENT FOR SKID STEER MACHINE

(71) Applicant: Darren P. Thompson, Rolette, ND (US)

(72) Inventor: Darren P. Thompson, Rolette, ND (US)

( * ) Notice: Subject to any disclaimer, the term of this patent is extended or adjusted under 35 U.S.C. 154(b) by 141 days.

(21) Appl. No.: 13/753,762

(22) Filed: Jan. 30, 2013

(51) Int. Cl.
*E02F 5/00* (2006.01)
*E02F 5/22* (2006.01)

(52) U.S. Cl.
CPC ..... *E02F 5/223* (2013.01)

(58) Field of Classification Search
CPC ..... E02D 3/032; E02F 3/80; E02F 5/10; E02F 5/223; E02F 5/226
USPC ..... 37/142.5, 405, 466; 172/81, 508, 509, 172/716; 405/154, 158, 179; 404/96–98
See application file for complete search history.

(56) References Cited

U.S. PATENT DOCUMENTS

| | | | | |
|---|---|---|---|---|
| 3,181,256 | A | 5/1965 | Discenza | |
| 3,233,350 | A | 2/1966 | Malzahn et al. | |
| 3,471,953 | A * | 10/1969 | Wyatt | 37/142.5 |
| 3,797,582 | A | 3/1974 | Couch | |
| 4,704,811 | A | 11/1987 | Jefferson | |
| 5,212,897 | A | 5/1993 | Jefferson | |
| 6,139,223 | A * | 10/2000 | Snyder | 405/179 |

* cited by examiner

*Primary Examiner* — Robert Pezzuto
(74) *Attorney, Agent, or Firm* — Robert C. Montgomery; Montgomery Patent & Design, LP

(57) ABSTRACT

A trench backfilling attachment for a vehicle or similar machine includes two material moving blades and a plurality of supporting structures securely connected to the vehicle. Upon forward motion of the vehicle, the material moving blades engage and manipulate collected ground material to fill an open utility trench.

18 Claims, 3 Drawing Sheets

BACKFILLING ATTACHMENT FOR SKID STEER MACHINE

RELATED APPLICATIONS

Not applicable.

FIELD OF THE INVENTION

The present invention relates generally to grading implements, and in particular, to a backfilling attachment for a vehicle, such as a skid steer machine, for filling an open utility trench with ground material.

BACKGROUND OF THE INVENTION

Small trenches are commonly used for underground utilities. These utilities include water, electric, telecommunication, sewer, and the like. While the time consuming process of hand digging such trenches is still performed, most trenches of any length are produced by a "DICTH-WITCH®", or similar large piece of equipment. Such equipment often places the removed soil on both sides of the trench. After the utility line has been placed, the trench must be backfilled. Once again, large pieces of mechanical equipment, such as front loaders, bulldozers, or even skid steer units, are called upon to assist. Unfortunately, due to the open trench, multiple passes are required which exposes the surrounding grade and grass area to more damage. Additionally, the trench is often unevenly backfilled, resulting in an uneven final grade after settling which requires a return visit, and additional cost.

Accordingly, there exists a need for a means by which small utility trenches can be easily backfilled to address the concerns as described above.

SUMMARY OF THE INVENTION

The inventor has recognized the aforementioned inherent problems and lack in the art and observed that there is a need for a device that can easily and quickly backfill an open utility trench. The development of the present invention, which will be described in greater detail herein, substantially departs from conventional solutions to provide a backfilling attachment for a vehicle and in doing so fulfills this need.

In one (1) embodiment, the disclosed backfill attachment can include a pair of material moving blades positioned at an angle relative to one (1) another, each of the blades having a front end and a rear end, a front supporting structure attached between the pair of blades proximate the front end, a rear supporting structure attached between the pair of blades proximate the rear end, and a pair of mounting plates attached to the front supporting structure and the rear supporting structure, each of the mounting plates blades being attachable to opposing operating arms of a vehicle.

In another embodiment, the disclosed backfill attachment can include a first material moving blade and a second material moving blade positioned at an angle relative to the first material moving blade, each of the blades having a front end and a rear end, a front supporting structure attached between the pair of blades proximate the front end, each of the material moving blades being rotatable about the front supporting structure to adjust the angle, a rear supporting structure attached between the pair of blades proximate the rear end, each of the material moving blades being linearly movable about the rear supporting structure, and a pair of mounting plates attached to the front supporting structure and the rear supporting structure, each of the mounting plates blades being attachable to opposing operating arms of a vehicle.

In another embodiment, disclosed is a method for backfilling an open utility trench, the method can include the steps of: providing a skid steer machine including a pair of operating arms, providing a backfill attachment including a pair of mounting plates attached to the pair of operating arms, a front and rear supporting structure attached to the mounting plates, and a pair of material moving blades adjustably attached to the front and rear supporting structure, the pair of material moving blades being adjustable at an angle relative to one (1) another; providing an open utility trench; providing a mass of ground material collected on opposed sides of the utility trench, positioning the backfill attachment over the open utility trench, positioning the pair of material moving blades to a position outside of the mass of ground material by adjusting the angle, propelling the skid steer machine in line with the open utility trench, and pushing the mass of ground material into the open utility trench.

Furthermore, the described features and advantages of the disclosed backfilling attachment for skid steer machine can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
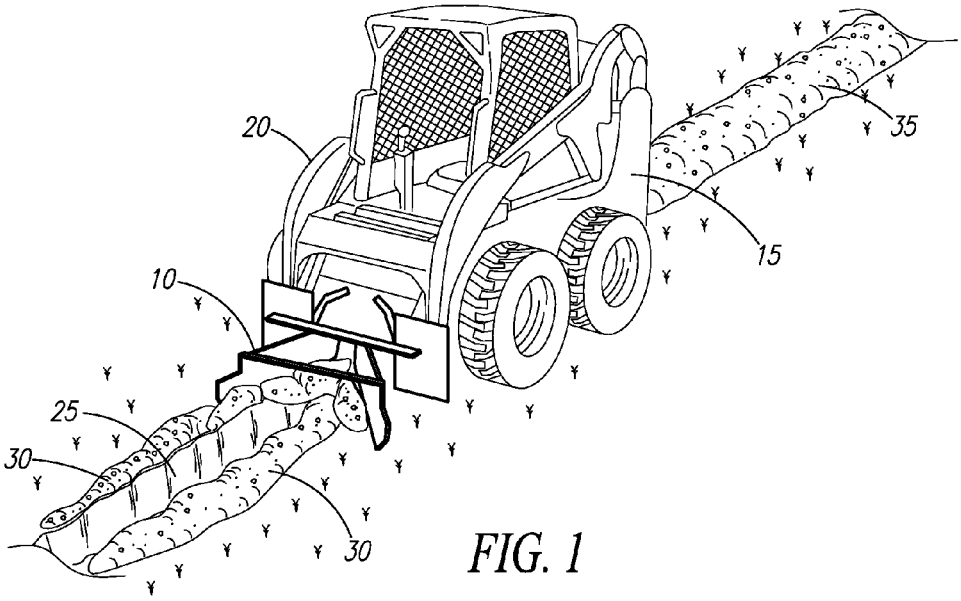
FIG. 1 is a perspective view of the disclosed backfilling attachment for skid steer machine shown in an utilized state, in accordance with the present invention.

10 backfilling attachment for skid steer machine
15 skid steer machine
20 operating arm
25 open utility trench
30 removed ground material
35 backfilled trench
40 material moving blades
45 front supporting structure
50 travel path direction arrow
55 utility lines
60 universal mounting plates
65 rear supporting structure
70 pivot point
75 adjustable locking mechanism
80 locking handles
85 variable opening "d"

90 side mounting plate
95 lower base arm
100 upper base arm
105 first retaining mechanism
110 second retaining mechanism
115 mechanical fastening means
120 angular travel path arrows

DETAILED DESCRIPTION OF THE PREFERRED EMBODIMENT

In accordance with the invention, the best mode is presented in terms of the described embodiments, herein depicted within FIGS. 1 through 5. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 5, disclosing a backfilling attachment for skid steer machine (herein referred to generally as an "attachment") 10, where like reference numerals represent similar or like parts.

Referring first to FIG. 1, the attachment 10 is attached to skid steer machine 15 via an operating arm 20 using conventional attachment methods. While the skid steer machine 15 is depicted as a skid steer machine, other similar machines such as a tractor or a front loader could be used with equal effectiveness, and as such, should not be interpreted as a limiting factor of the present disclosure.

During use, the skid steer machine 15 is located over a open utility trench 25 in a parallel fashion such that the centerlines of both the skid steer machine 15 and the open utility trench 25 are the same in a vertical plane, such that the open utility trench 25 is "straddled" by the skid steer machine 15. The backfilling attachment for skid steer machines 10 is used to push removed ground material 30, located on either side of the open utility trench 25, back into the open utility trench 25. The action of the attachment 10 on the skid steer machine 15 thus produces a backfilled trench 35 as a result. It is envisioned that the attachment 10 could be easily adapted for use on almost any make or model of skid steer machine 15 and as such should not be interpreted as limiting factor of the present disclosure. It is also envisioned that the attachment 10 could be utilized with any type of soil conditions including sandy, silty, clay, peaty, saline soil, or loam.

Figure 2:
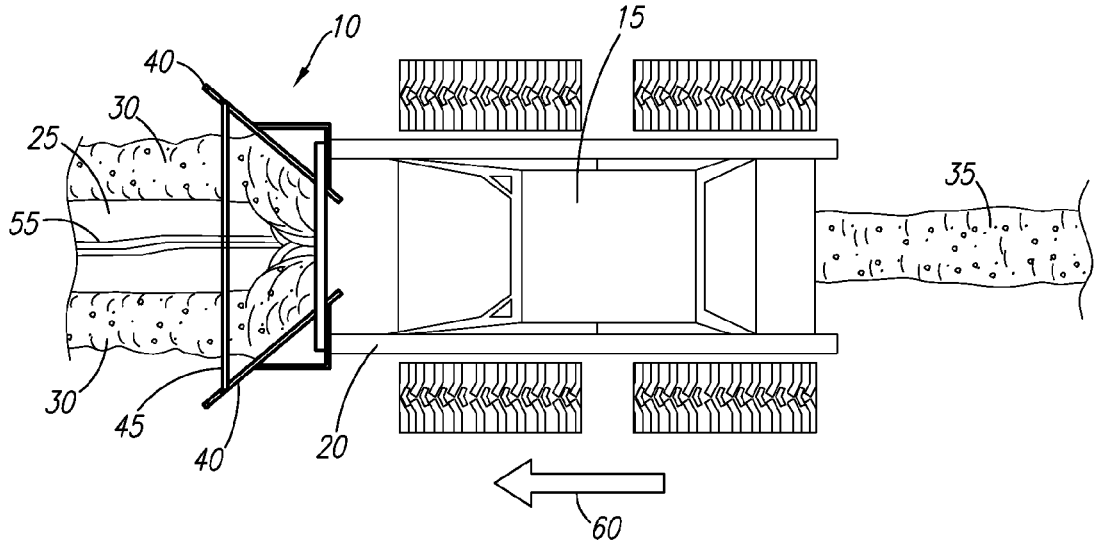
FIG. 2 is a top view of the disclosed backfilling attachment for skid steer machine.

Referring next to FIG. 2, this figure more clearly shows the attachment 10 mounted upon the skid steer machine 15 using the operating arm 20. The attachment 10 includes two (2) material moving blades 40 arranged in a "V"-shaped pattern. The material moving blades 40 are held in place by a front supporting structure 45 which will be described in greater detail herein below. The material moving blades 40 are used to push the removed ground material 30 back into the open utility trench 25 (FIGS. 1 and 2) as the skid steer machine 15 moves forward by a travel path direction arrow 50. Such equal movement of the removed ground material 30 on both sides of the open utility trench 25 produces an even and consistent backfilled trench 35 with little or no irregularities in backfill level. The action results in a backfilled trench 35 that will be level with the adjacent grade after a short period of time and will not require additional fill or grading work at a later point in time.

The presence of utility lines 55 at the bottom of the open utility trench 25 is also visible. The utility lines 55 are envisioned to include piping used to carry water, gas, sewage or other liquids or gasses, as well as conduits used to carry electrical power, control or data lines. Other materials such as direct buried cable, marker tape, duct banks, and the like can also be utilized with the attachment 10, and as such, should not be interpreted as a limiting factor of the present disclosure.

Figure 3:
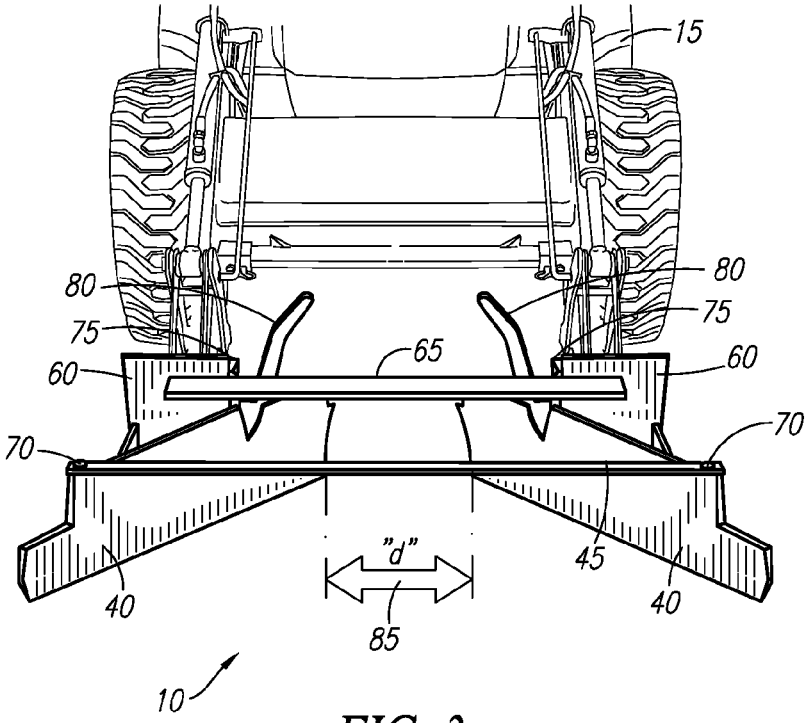
FIG. 3 is a front view of the disclosed backfilling attachment for skid steer machine.

Referring next to FIG. 3, two (2) universal mounting plates 60 are utilized to attach the attachment 10 to the operating arm 20 of the skid steer machine 15. The universal mounting plates 60 accommodate almost all makes and models of skid steer machine 15. A standard attachment method, such as pin and retaining clips, would be utilized. Other attachment methods such as locking brackets, bolts, and the like may also be utilized without impacting the functionality of the attachment 10 and as such, should not be interpreted as a limiting factor of the present disclosure. The universal mounting plates 60 are attached to the front supporting structure 45 as well as a rear supporting structure 65. In turn, the material moving blades 40 are attached to the front supporting structure 45 using a pivot point 70 to support the leading (i.e., front) or distal edge of the material moving blades 40 when viewed from the position of the driver of the skid steer machine 15.

The proximal end of the material moving blades 40 are supported by adjustable locking mechanism 75 on the rear supporting structure 65. The adjustable locking mechanism 75 uses a pin-and-hole arrangement controlled by a series of two (2) locking handles 80 to control the position of the material moving blades 40. The control generates a variable opening "d" 85 between the two (2) material moving blades 40. The control provides user controlled compensation of the width of the open utility trench 25 (FIGS. 1 and 2) which needs to be backfilled. Overall width of the attachment 10 is approximately four feet (4 ft.).

Figure 4:
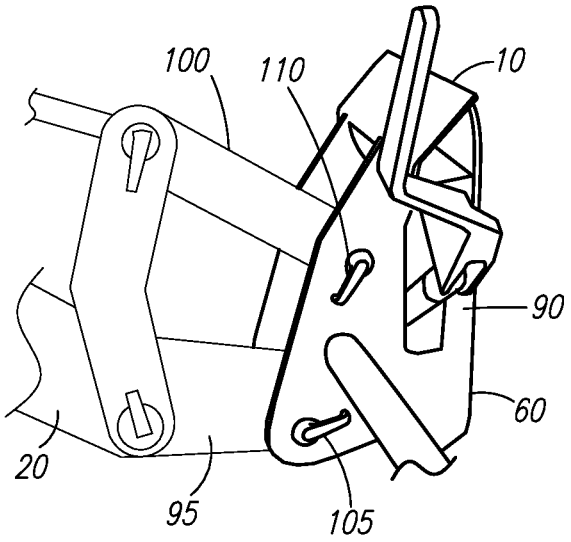
FIG. 4 is a side view of the disclosed backfilling attachment for skid steer machine; and, FIG. 5 is a top view of the disclosed backfilling attachment for skid steer machine.

Referring next to FIG. 4, this figure more clearly depicts the connection of the attachment 10 to the operating arm 20. The universal mounting plates 60 are provided with a side mounting plate 90. The operating arm 20 provides a lower base arm 95 and upper base arm 100 which is connected to the universal mounting plates 60 with the aid of a first retaining mechanism 105 and a second retaining mechanism 110, respectively.

The first retaining mechanism 105 and the second retaining mechanism 110 are envisioned to be pin-and-clip arrangement, a bolt, a locking lever or the like. This feature allows the attachment 10 to be quickly applied as well as removed from the skid steer machine 15 in an easy process using a few or even no hand tools. It should be noted that while only one side of the attachment 10 is depicted in FIG. 4 due to illustrative limitations, the opposing side is of an identical mirrored nature.

Figure 5:
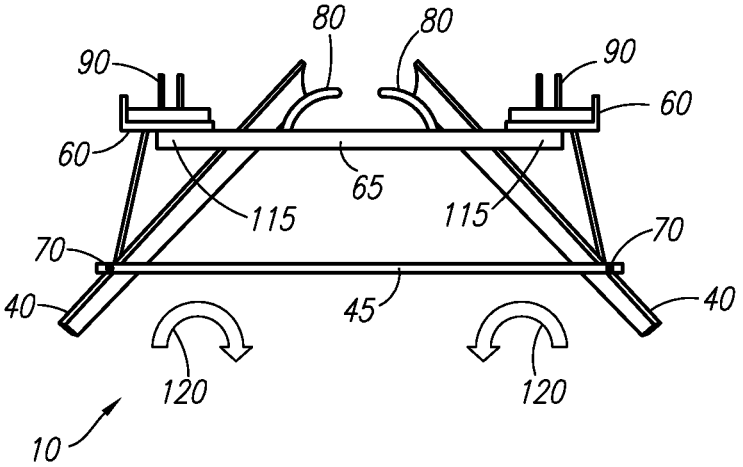

Referring finally to FIG. 5, this figure more clearly depicts the arrangement between the two (2) material moving blades 40 and the front supporting structure 45 and the rear supporting structure 65. Additionally, the side mounting plate 90 are shown protruding in a rearward fashion from the universal mounting plates 60, which are in turn permanently fastened to the front supporting structure 45 via a mechanical fastening means 115, such as welding. It should be noted that the pivot point 70 allows for the material moving blades 40 to move up to between approximately twenty-five degrees (25°) and forty-five degrees (45°) as depicted by angular travel path arrows 120.

Two (2) locking handles 80 are at the rear of the attachment 10 where they may be adjusted manually. It should be noted that the majority of the components as used in the attachment 10 would be of a high strength metal material such as forged steel. After manufacture of the attachment 10, a suitable protective finish such as paint or plating would be applied to prevent corrosion.

It is envisioned that other styles and configurations of the disclosed attachment 10 can be easily incorporated into the teachings of the present disclosure, and only certain particular configurations have been shown and described for purposes of clarity and disclosure and not by way of limitation of scope.

The disclosed attachment 10 can be installed and utilized by the common user in a simple and effortless manner with little or no training. After initial purchase or acquisition of the attachment 10, it can be installed and utilized as indicated in FIGS. 1-5.

Well known metal forming and finishing methods would be utilized during manufacture. Associated components and fasteners would be added during the assembly process. A suitable protective finish, such as paint or plating, would be applied to prevent corrosion.

Prior to utilizing the attachment 10, it would be connected to a suitable skid steer machine 15 via the operating arm 20. The connection would be made via the lower base arm 95 and the upper base arm 100 connecting to the side mounting plate 90 on the universal mounting plates 60 via the first retaining mechanism 105 and the second retaining mechanism 110, respectively. Next, the material moving blades 40 would be adjusted using the locking handles 80 to produce a suitable variable opening "d" 85 such that the variable opening "d" 85 matches the width of the open utility trench 25. At this point in time, the attachment 10 is ready for use.

During use of the attachment 10, the skid steer machine 15 is driven over the open utility trench 25 in a manner parallel to that of the path of the open utility trench 25. Next, the operating arm 20 of the skid steer machine 15 is lowered such that the front supporting structure 45 is perpendicular to the open utility trench 25 and each of the two (2) material moving blades 40 engage the backfilled trench 35 on each side of the open utility trench 25. The skid steer machine 15 may then be driven forward in a slow fashion while the removed ground material 30 is pushed back into the open utility trench 25 thus covering any utility lines 55 and generating a backfilled trench 35. Such utilization results in an open utility trench 25 being more quickly and evenly filled resulting in even grade over time with little or no likelihood of additional grading or site work. The process can be repeated with additional open utility trench 25 as required, or the attachment 10 can be removed from the skid steer machine 15 to allow the skid steer machine 15 to serve other functions without the attachment 10 attached.

The foregoing embodiments of the disclosed backfilling attachment for skid steer machine have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A backfill attachment for a vehicle, said attachment comprising:

a pair of material moving blades positioned at an angle relative to one another, each of said blades comprising a front end and a rear end;

a front supporting structure attached to and extending between said pair of blades proximate said front end;

a rear supporting structure attached to and extending between said pair of blades proximate said rear end; and, a pair of mounting plates attached to said front supporting structure and said rear supporting structure, each mounting plate of said pair of mounting plates being attachable to opposing operating arms of said vehicle; and, wherein each of said moving blades is pivotally attached to said front supporting structure by a pivot point.

2. The attachment of claim 1, wherein said mounting plates are attached to said operating arms by at least one retaining mechanism.

3. The attachment of claim 2, wherein each of said mounting plates is attached to each of said operating arms by an upper first retaining mechanism and a lower second retaining mechanism.

4. The attachment of claim 2, wherein each of said mounting plates comprises a pair of spaced a part side mounting plates, and wherein each of said operating arms is received between each of said pair of side mounting plates.

5. The attachment of claim 4, wherein each of said operating arms is attached to said side mounting plate by at least one retaining mechanism.

6. The attachment of claim 4, wherein each of said operating arms is attached to said side mounting plate by an upper first retaining mechanism and a lower second retaining mechanism.

7. The attachment of claim 1, wherein said angle is adjustable between 25 and 45 degrees.

8. The attachment of claim 1, wherein each of said moving blades is attached to said rear supporting structure is by an adjustable locking mechanism; and, wherein each of said moving blades is rotatable about said pivot point to adjust said angle.

9. The attachment of claim 8, wherein said locking mechanism comprises a locking handle attached to said moving blade and releasably attached to said rear supporting structure; and, wherein linear movement of said locking handle along said rear supporting structure adjusts said angle.

10. The attachment of claim 9, wherein said angle is adjustable between 25 and 45 degrees.

11. The attachment of claim 1, wherein each of said moving blades is attached to said rear supporting structure is by an adjustable locking mechanism; and, wherein each of said blades is rotatable about said front supporting structure to adjust said angle.

12. The attachment of claim 11, wherein said locking mechanism comprises a locking handle attached to said moving blade and releasably attached to said rear supporting structure; and, wherein linear movement of said locking handle along said rear supporting structure adjusts said angle.

13. The attachment of claim 12, wherein said angle is adjustable between 25 and 45 degrees.

14. A backfill attachment for a vehicle, said attachment comprising:

a first material moving blade and a second material moving blade positioned at an angle relative to said first material moving blade, each of said blades comprising a front end and a rear end;

a front supporting structure attached to and extending between said pair of blades proximate said front end, each of said material moving blades being rotatable about said front supporting structure to adjust said angle;

a rear supporting structure attached to and extending between said pair of blades proximate said rear end, each of said material moving blades being linearly movable about said rear supporting structure; and, a pair of mounting plates attached to said front supporting structure and said rear supporting structure, each mounting plate of said pair of mounting plates being attachable to opposing operating arms of said vehicle; and, wherein each of said moving blades is rotatably attached to said front supporting structure by a pivot point, said pivot point comprising an axis of rotation.

15. The attachment of claim 14, wherein each of said mounting plates comprises a pair of spaced a part side mounting plates, and wherein each of said operating arms is received between each of said pair of side mounting plates.

16. The attachment of claim 15, wherein each of said operating arms is attached to said side mounting plate by an upper first retaining mechanism and a lower second retaining mechanism.

17. The attachment of claim 16, wherein each of said material moving blades is attached to said rear supporting structure is by an adjustable locking mechanism.

18. The attachment of claim 17, wherein said locking mechanism comprises a locking handle attached to said material moving blade and releasably attached to said rear supporting structure; and, wherein linear movement of said locking handle along said rear supporting structure adjusts said angle between 25 degrees and 45 degrees.

* * * * *